US005285607A

United States Patent [19]

Somerville

[11] Patent Number: 5,285,607

[45] Date of Patent: Feb. 15, 1994

[54] BUILDING EXTERIOR WALL PANEL

[75] Inventor: John W. Somerville, Green Bay, Wis.

[73] Assignee: Somerville Associates Inc., Green Bay, Wis.

[21] Appl. No.: 719,112

[22] Filed: Jun. 21, 1991

[51] Int. Cl.[5] ..... E04C 1/00

[52] U.S. Cl. ..... 52/235; 52/309.7; 52/309.16

[58] Field of Search ..... 52/309.7, 309.8, 309.12, 52/235 OR, 309.16

[56] References Cited

U.S. PATENT DOCUMENTS

| | | | |
|---|---|---|---|
| 3,313,073 | 4/1967 | Mathews | 52/309.7 |
| 3,401,494 | 9/1968 | Anderson | 52/309.7 |
| 4,241,555 | 12/1980 | Dickens et al. | 52/309.7 |
| 4,288,962 | 9/1981 | Kavanaugh | 52/220 |
| 4,480,416 | 11/1984 | Judkins et al. | 52/309.7 |
| 4,641,468 | 2/1987 | Slater | 52/309.7 |
| 4,641,469 | 2/1987 | Wood . | |
| 4,813,193 | 3/1989 | Altizer | 52/309.7 |
| 4,875,322 | 10/1989 | Rozzi | 52/309.7 |
| 4,961,298 | 10/1990 | Nogradi . | |

*Primary Examiner*—Carl D. Friedman
*Assistant Examiner*—Wynn Wood
*Attorney, Agent, or Firm*—Thomas D. Wilhelm

[57] ABSTRACT

Exterior insulating building wall panels are disclosed. The wall panels comprise an insulating plastic foam board having disposed therein one or more structural reinforcing members strong enough that the wall panel can be used to span between primary structural framing members of the building without surface supporting assistance from any intervening structural element or supporting substrate. In the preferred embodiments, Truss T's are embedded in channels in the plastic foam board, parallel to each other, and are held in the channels by beds of adhesive and perimeter C-channels. The wall panels are mounted to the building primary framing members by clips which are e.g. welded to the primary framing member and are movably mounted to the structural reinforcing members in the wall panel. Methods of fabricating the wall panels, and methods of installing the wall panels on buildings are also disclosed, as well as the resulting building structural wall system.

11 Claims, 7 Drawing Sheets

BUILDING EXTERIOR WALL PANEL

BACKGROUND OF THE INVENTION

It is known that foamed polystyrene board is a highly effective thermal insulation material for use in building construction. It is also known to make a building exterior wall panel at the building site by first mounting the foam board as cladding on the building exterior sheathing, and then placing a reinforcing mesh on the outside surface of the foamed board and embedding the mesh in an acrylic adhesive coating material, thereby bonding the mesh to the board. The resulting composite exterior sheathing of the building comprises the polystyrene foam board, the adhesive coating, and the mesh embedded therein.

U.S. Pat. No. 4,641,469 Wood teaches constructing an exterior building wall panel away from the building site, using the foam board, the mesh and the acrylic coating. Metal attaching strips are inserted longitudinally into the board as seen in Prior Art FIGS. 1 and 2. The attaching strips may extend from the edge of the board and are used to attach the panel to the building.

U.S. Pat. No. 4,961,298 Nogradi teaches using a "C"-shaped strip as the metal attaching strip. As an improvement over Wood, the attaching strip of Nogradi can be installed in the board by transverse movement of the metal strip relative to the channel in the board.

Both the Wood and Nogradi panels use a supporting sheathing surface behind substantially their entire surface areas, as illustrated by the concrete blocks of Prior Art FIG. 2 and the sheathing (typically gypsum board) seen in Prior Art FIG. 1. Prior Art FIG. 3 shows a generic vertical cross-section of part of a building wall using the wall panel of Wood, and includes a building stud sheathed on both sides with gypsum board, with the exterior wall panel disposed on the outer supporting surface "S" of the outer layer of sheathing.

It is an object of this invention to provide improved exterior wall panels having the insulating properties and lighter weight advantages of light weight plastic foam.

It is another object to provide light weight structural wall panels having the insulating properties of light weight plastic foam.

It is still another object to provide wall structures which are lighter in weight, and are less costly than conventional wall structure systems.

SUMMARY OF THE DISCLOSURE

Some of these objects are achieved in a structural exterior building wall panel comprising a board and reinforcing structural means disposed within the board, whereby the wall panel is suitable for use as a structural element of the building. The board generally comprises an effectively unitary slab of plastic foam material having a major surface adapted for disposition toward the interior of the building, and has a heat insulation R-value of at least R2, preferably at least R3, more preferably at least R4 per inch thickness.

The reinforcing structural means is secured to the foamed board such that the board and the reinforcing structural means act cooperatively as a unitary structure. The resulting building wall panel has sufficient strength to accommodate a live loading of at least 20 pounds per square foot (20 PSF).

Preferably the structural means comprises a plurality of structural members such as Truss T's or the like, which have external flanges adapted to be mounted to a primary frame member of the building, a web extending from the external flange into the interior of the board and terminating on the interior of the board, and an internal narrower flange extending transversely from the web in opposing directions on the interior of the board.

In some preferred embodiments, the board has a plurality of edge surfaces about the perimeter of the major surface, the board having, on the edge surfaces, elongate slots parallel to the major surface and recessed into the edge surfaces. The slots are adapted to receive reinforcing members therein along the lengths of the respective edge surfaces. Elongate reinforcing elements have a C-channel shaped cross-section, including a web joining a pair of oppositely disposed, generally parallel flanges, one such flange being secured in the respective slot, the other flange being disposed proximate the respective edge surface on, and extending over, a respective edge portion of the major surface, and over end portions of any respective external flanges disposed adjacent that edge surface.

The structure of the wall panel preferably includes a first bed of adhesive in the bottom of each channel generally between walls of the channel and the internal flange, and extending above the internal flange. Thus a portion of the first bed of adhesive is disposed between the internal flange and the major surface of the board. A second bed of adhesive is disposed between the external flange of the structural member and an underlying portion of the board. Typically, and preferably for conservation of materials and cost, there is a space in the channel between the first and second beds of adhesive, the space being substantially free from functionally effective amounts of adhesive.

In some embodiments, each channel comprises a pair of channel members, and each structural member comprises an external flange extending along the length thereof, a pair of webs on opposing sides of the external flange, extending along the length of the external flange and into the board, and internal flange members on each web; the internal flange members extending transversely from the respective webs, the dimensions of the internal flange members transverse to the webs and the widths of the respective channel members being cooperatively sized and configured such that the respective internal flange members can be received within the respective channel members along the extent of the depths of the channel members as taken progressively from the major surface.

The building wall panels preferably include clips secured for limited movement onto the external flanges of the trusses and configured to be secured to primary framing members of the building. The moveable securement of the clips to the external flanges combined with rigid (e.g. welded) securement of the clips to the primary building framing members accommodates minor shifting of the building elements.

The invention also comprehends a method of fabricating a structural exterior building wall panel having a foam board comprising an effectively unitary slab of plastic foam material, the slab having a major surface adapted for disposition toward the interior of the building, the major surface having a plurality of generally parallel channels extending thereacross, and a plurality of elongate structural members in the channels, each elongate structural member comprising an external flange adapted for disposition adjacent the major surface, a web extending from the external flange into the interior of the board and terminating on the interior of the board, and internal flange means extending transversely from the web on the interior of the board and thereby defining a width of the structural member on the interior of the board. The method comprises the steps of cutting the channels in the major surface of the board, each channel having a depth and a width, the widths and depths of the channels being cooperatively dimensioned with respect to the internal flange means such that the internal flange means can be received within the channels along the extent of the depths of the channels; applying a bed of adhesive in the bottom of each channel, sufficient in quantity to surround and cover the internal flange means, but insufficient to fill the channels when the internal flange means is inserted therein; inserting the structural members into the channels in a direction transverse to the lengths of the channels and the structural members; and maintaining the positions of the structural members and the board, relative to each other, for a sufficiently long time for the adhesive to cure.

A preferred method includes maintaining a space between the external flange of the structural member and the respective adjacent portion of the major surface proximate opposing ends of the wall panel corresponding to respective ends of the external flanges; and securing, for limited movement, clips adapted for mounting the wall panel to a primary framing member of the building, to the external flanges of the structural members proximate the ends of the external flanges.

The method of installing the wall panels on a building includes the steps of emplacing, in cooperative attaching relation to primary framing members of the building, a wall panel comprising the clips; positioning the clips along the wall panel, such that attachment means on the clips are proximate corresponding ones of the primary framing members of the building, and securing the clips to the primary framing members. The clips are thus fixedly secured to the primary framing members of the building and are movably secured to the wall panels. Accordingly, the panels can move a limited amount with respect to the primary framing members to accommodate minor shifting of the building elements.

The invention further comprehends a building structural system, comprising a plurality of building primary framing members having first portions thereof spaced from each other, and second portions thereof cooperatively joined to each other to thereby define the primary building frame; and a plurality of structural wall panels attached directly to the primary framing members without intervening secondary structural members.

Finally, the invention contemplates buildings made by the methods, and with the wall panels, disclosed herein.

DETAILED DESCRIPTION OF THE ILLUSTRATED EMBODIMENTS

Figure 5:
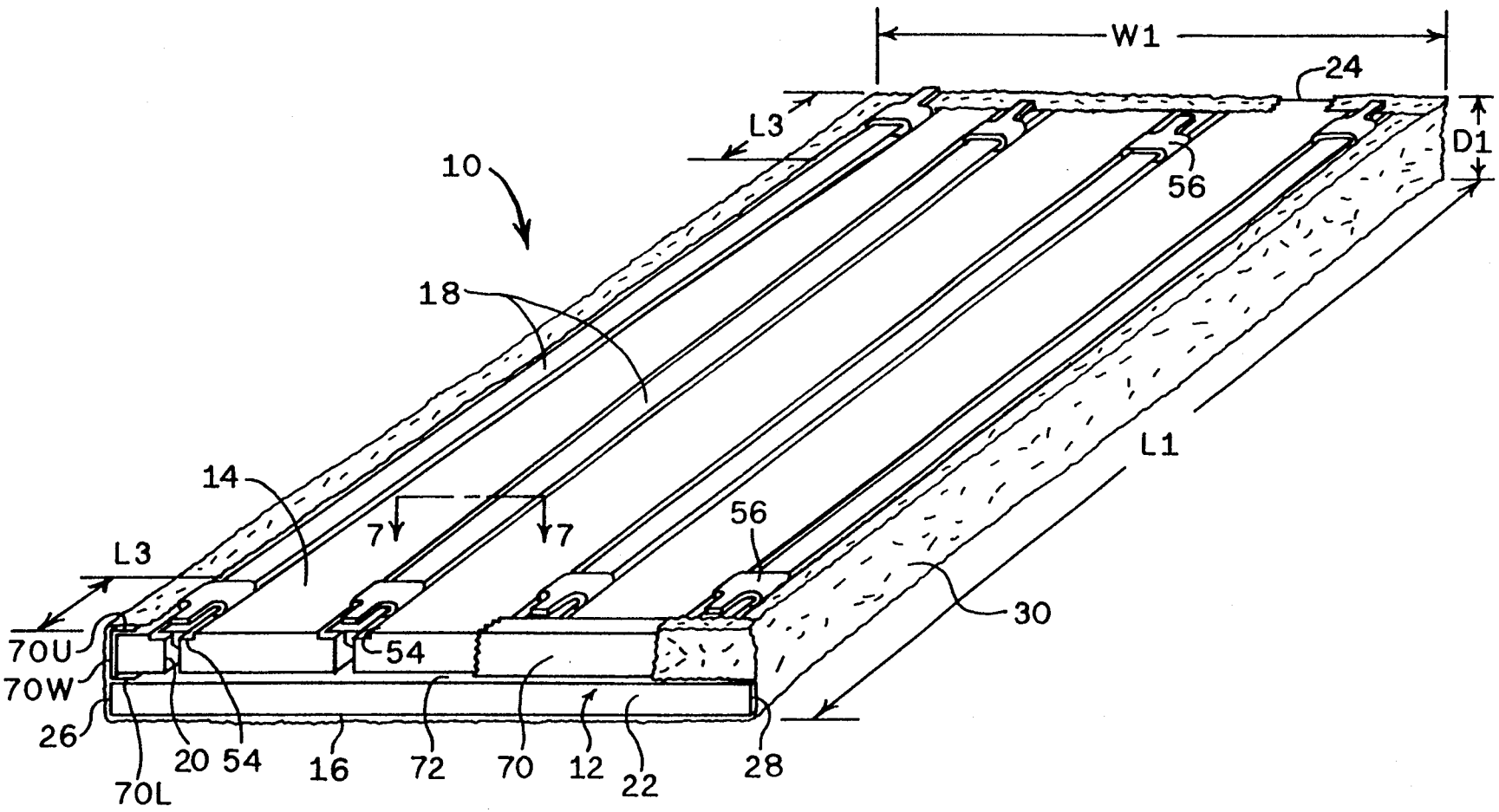
FIG. 5 is a pictorial view of a structural wall panel of this invention, with part of one end surface removed.

FIG. 5 shows an overall pictorial view of a structural wall panel of this invention. The wall panel 10 has an overall length "L1", an overall width "W1", and an overall depth "D1". The substrate of wall panel 10 comprises a board 12 of light weight foamed plastic having a heat insulation R-value of at least R2 per inch thickness, preferably at least R3, most preferably at least R4. Typical such boards comprise foamed polystyrene or foamed polyurethane, both of which are well known for their insulating value, and for use as insulation materials in building construction. A variety of foamed plastics materials are known to have acceptable such properties, whereby such insulation board need not be further described here.

Board 12 has first and second major surfaces 14, 16. Major surface 14 is adapted for disposition toward the interior of the building when the wall panel is emplaced thereon. A plurality of structurally reinforcing elongated Truss T's 18 are arrayed across major surface 14 in correspondingly parallel and elongated channels 20 which extend generally along the length "L1" of the wall panel, between opposing end surfaces 22, 24 of board 12.

Figure 6:
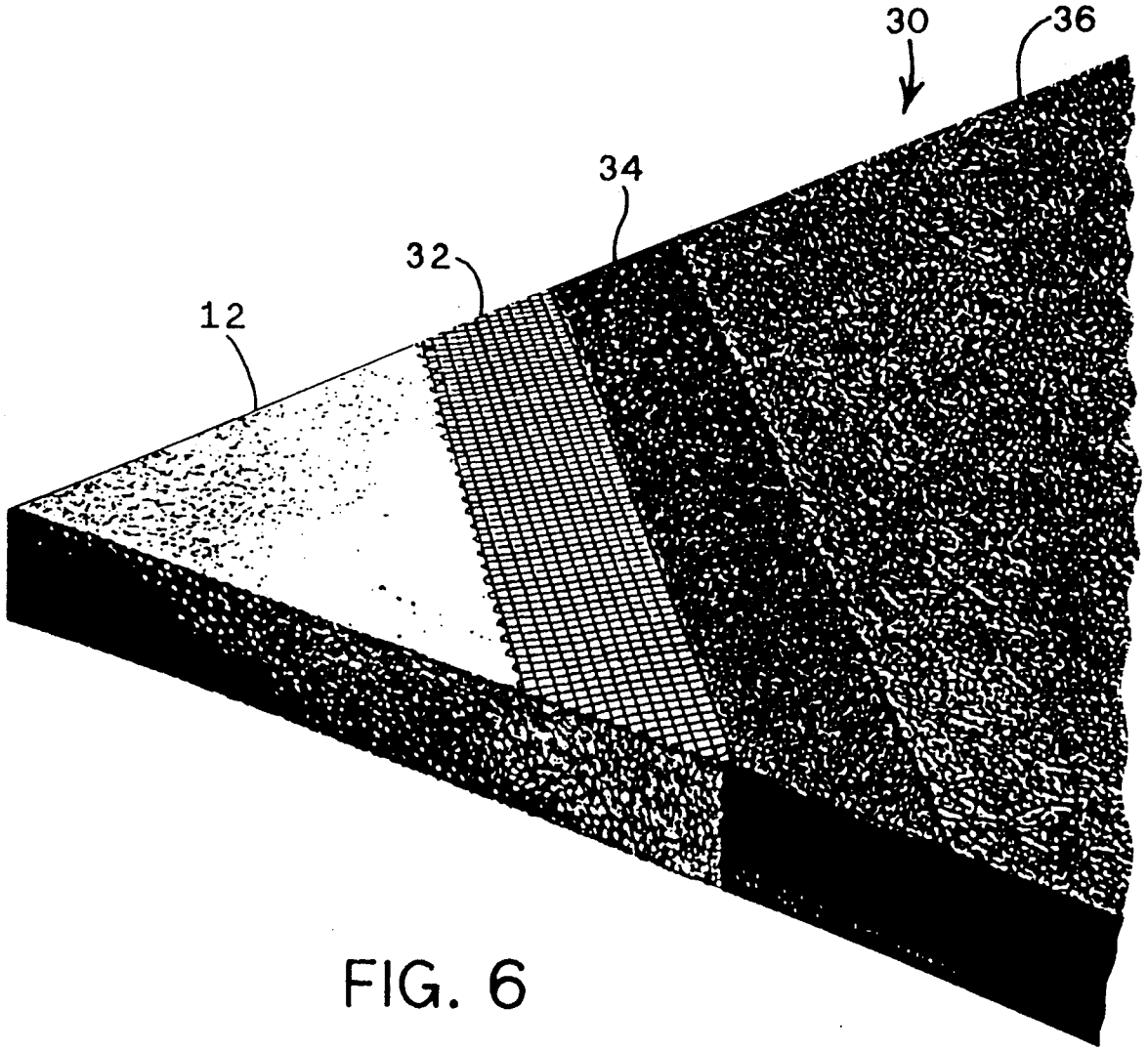
FIG. 6 shows typical layering of the outer skin.

Major surface 16, side surfaces 26, 28, and end surfaces 22, 24 are covered by an outer skin composite material 30. Skin composite material 30 comprises e.g. a reinforcing mesh 32 of interlaced fiberglass, 20 grams per square yard, embedded in an adhesive coating material 34 which effectively bonds the skin composite to the foam. See FIG. 6. An outer acrylic skin coating 36 is optionally applied on the adhesive coating 34 and, when so used, forms the outside surface of the wall panel, and accordingly the outer surface of the building on which the wall panel is emplaced. Polystyrene boards coated with such skin composite material 30, including the skin coating 36, are available from Dryvit Systems, Inc., Arlington, Tex. An alternate skin coating material is metal sheet such as aluminum, which can be bonded to the board 12 with appropriate adhesive, the selection of which is conventional once the board and skin materials are specified.

Figure 7:
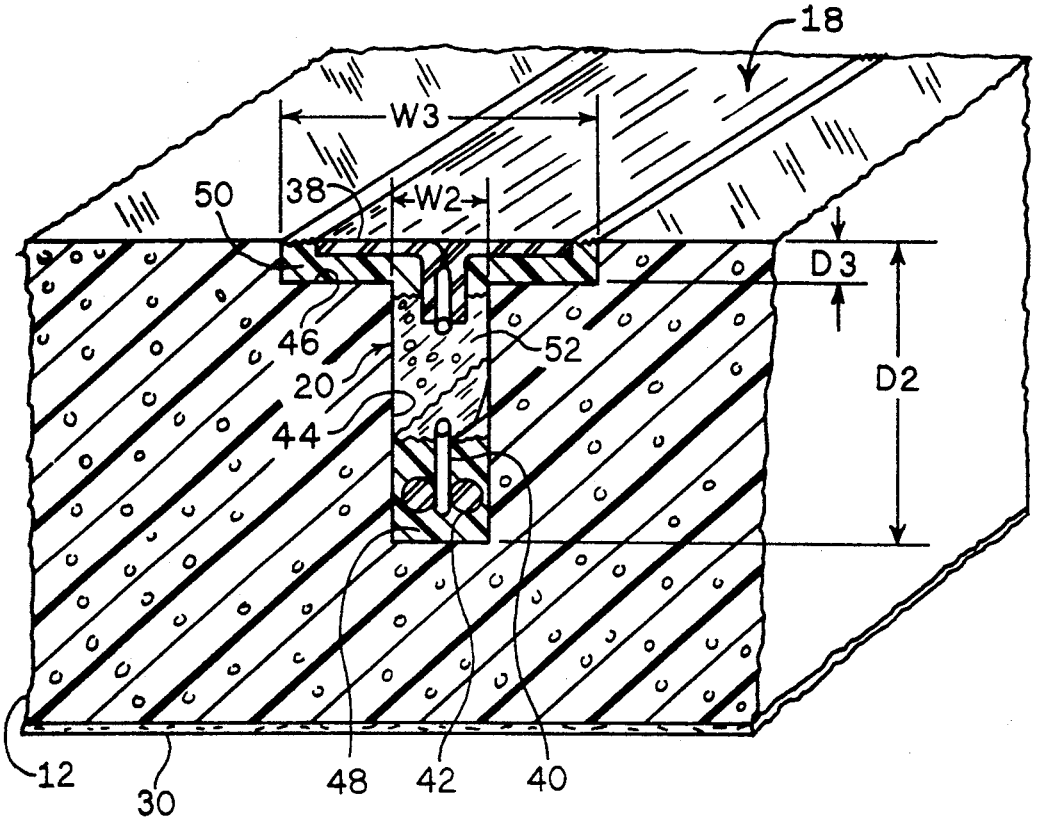
FIG. 7 is an enlarged section taken at 7—7 in FIG. 5 and shows detail of the relative cooperations among the channel, the strengthening member, and the adhesive.

Turning now to FIG. 7, the Truss T 18 has an external flange 38, a web 40 made of wire in a truss configuration, and an internal flange namely chord 42 comprising the web wire and an opposing pair of flange wires; the Truss T generally defining a "T-shaped" structural member having feet (the wires defining internal chord 42) at the base of the "T". Such trusses are available from Tech Truss Tees, Inc., Newark, Ohio, in a variety of sizes, with corresponding known resisting moments. External flange 38 and web 40 are well known as truss elements. Chord 42 is less well known, and concentrates the strengthening chord mass in a relatively narrower width than external flange 38, whereby the assembly of the truss into the board is facilitated.

Accordingly, elongated channel 20 has a correspondingly elongated channel slot member 44 having depth D2 and width W2, which receives web 40 and bulb flange 42 of the truss; and a correspondingly elongated flange recess 46, having depth D3 less than D2, and width W3 greater than W2, which receives external flange 38 of the truss 18. A first bed of adhesive 48 receives and surrounds internal chord 42, and a lower portion of web 40 along the length of slot 44. A second bed of adhesive 50 receives external truss flange 38 in flange recess 46. The two beds of adhesive 48, 50 accordingly secure truss 18 in channel 20. The first bed 48 of adhesive is preferably deep enough to cover and surround internal chord 42. The second bed 50 of adhesive generally serves as a bonding interface between external flange 38 and flange recess 46. Suitable adhesives for use in adhesive beds 48, 50 are MOR-AD 434-A adhesive, a one part urethane prepolymer from Morton Thiokol, Inc., or MOR-AD 42-179 also from Morton Thiokol. Such adhesives have sufficient cohesive strength and sufficient adhesive bonding strength between truss 18 and board 12 that it is not necessary to entirely fill the channel 20 with adhesive. Accordingly, the fabricated wall panel preferably includes a correspondingly elongated space 52 between beds of adhesive 48 and 50. Bed of adhesive 48 extends the full length of channel 20, between end surfaces 22, 24 and generally surrounds internal chord 42 along its entire length. Bed of adhesive 50 extends generally the full length of channel 20, underlying external flange 38, but stops short of end surfaces 22, 24. Accordingly, along minor length segments "L3" of the channel/truss combination, proximate ends 22, 24, flange recess 46 is devoid of adhesive, whereby there is a space 54 between truss external flange 38 and flange recess 46 along lengths of segments "L3".

While use of flange recess 46 is preferred, its presence and use are optional. If flange recess 46 is not used, the bottom surface of flange 38 is disposed on major surface 14 of board 12 at the edges of channels 20 along their lengths, with intervening bed of adhesive 50.

Figure 9:
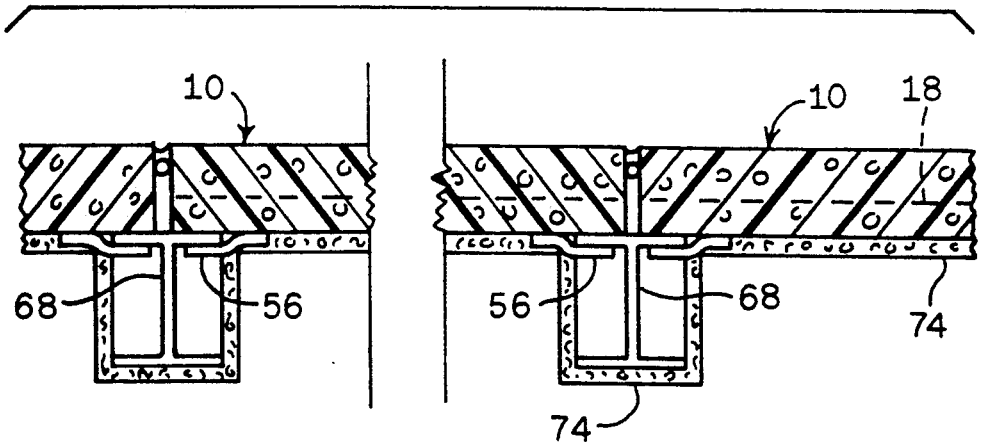
FIG. 9 shows a cross-section taken from the top of a wall with sections cut out, wherein a plurality of the wall panels are positioned in abutting relationship with each other, and are secured to the building primary framing members by the clips.
Figure 8:
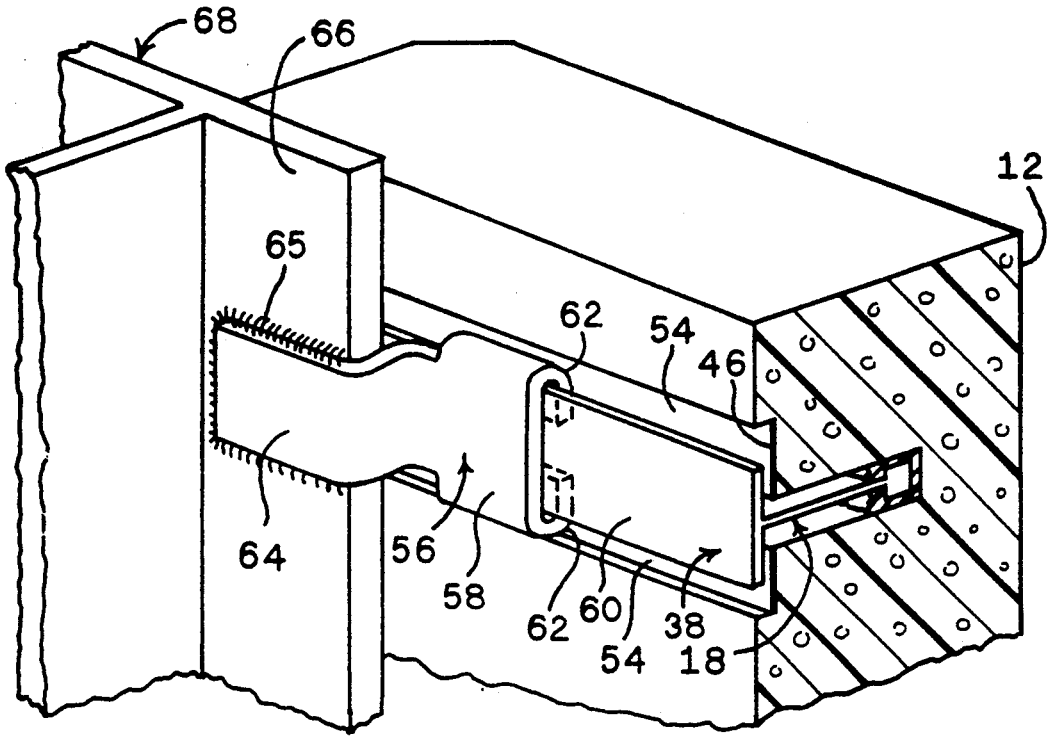
FIG. 8 is an enlarged fragmentary view showing the clip retaining the wall panel to a building frame member.

A plurality of clips 56 are disposed on the external flanges 38 of the truss, one along each length segment "L3". The general disposition of the clips is seen in FIG. 5. The detail of the clips 56 is seen in FIG. 8. As seen therein, a clip 56 includes a main body portion 58 disposed generally parallel to, and proximate, the external surface 60 of truss external flange 38. A pair of legs 62 loosely encircle the edges of external flange 38 in the space 54 between truss flange 38 and channel flange member 46; and are thus engaged with truss flange 38 for limited (sliding) movement. Lip 64 extends from main body portion 58 along the length of truss 18 and spaced away from truss external flange 38. Accordingly, as clip 56 is slid along truss flange 38, lip 64 is extended over the flange 66 of an upstanding wide flange column 68 which comprises part of the primary framing of the building; with the column flange 66 thus being disposed between lip 64 and truss flange 38. FIG. 9 shows clips 56 securing wall panels 10 in abutting relationship on two spaced-apart wide flange column primary framing members of the building.

As referred to herein, the primary framing members comprise the columns and beams that constitute the primary weight bearing members of the building. Such primary framing members are typically spaced more than 24 inches apart, and may be spaced up to 10–15 feet apart.

Figure 3:
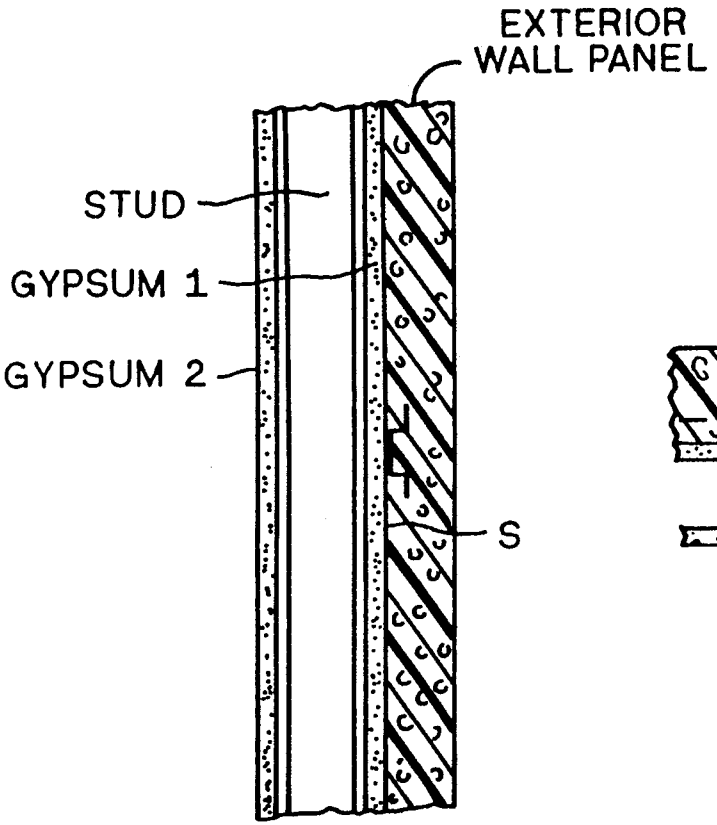
FIG. 3 PRIOR ART
FIG. 3 is a fragmentary wall cross-section showing use of prior art wall panels of Wood, U.S. Pat. No. 4,641,649 .

Studs are lighter gauge secondary framing members, typically attached to the primary framing member beams, and are typically spaced either 16 inches or 24 inches on center. Typical exterior sheathing such as Gypsum 1 (FIGS. 3–4) is attached to the studs.

In this invention, wherein the wall panel 10 is attached directly to the primary framing members, both the studs and the exterior sheathing (Gypsum 1) are extraneous and not used, and the one gypsum (interior wall) panel 74 which is used is disposed on the major surface 14 of the wall panel 10, whereby the additional interior square footage of the thicknesses of the studs (not used) and one sheathing layer (not used) is captured as additional useable space on the interior of the building.

Returning again to clips 56, the configuration of lips 64 is designed according to the frame surface (e.g. column flange 66) with which it interfaces, whereby the direction of disposition of lips 64 varies from building to building, according to the design of the building frame members.

Figure 10:
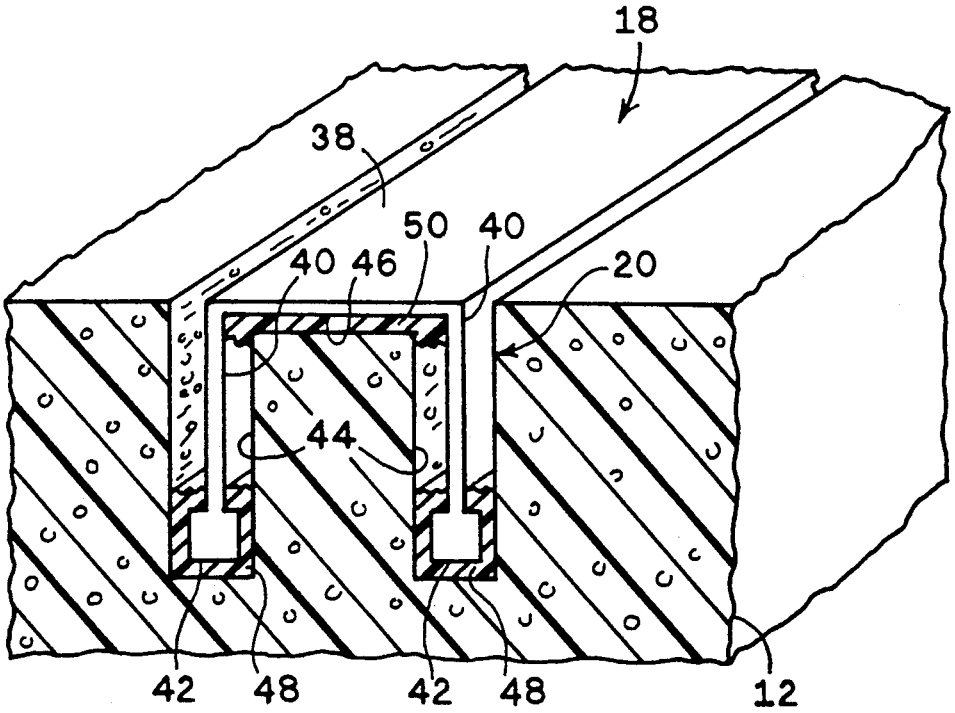
FIG. 10 shows a cross-section of an alternative, "C"-shaped, reinforcing member having the disclosed internal flanges.

An illustrative alternate embodiment of the wall panels is shown in FIG. 10. The structural reinforcing member 18 in FIG. 10 comprises an external flange 38, a pair of webs 40, and a pair of internal chords 42 extending transverse to the respective webs 40. The channel 20 comprises a pair of slots 44 and a flange recess 46 therebetween. Two beds of adhesive 48 surround the respective two internal chords 42 and bed of adhesive 50 secures truss external flange 38 to flange recess 46.

The strengthening members 18 can be made according to a variety of specifications. As illustrated in FIG. 7, a suitable Truss T has a generally plate-like flange 38, web 40 made with wire in the manner of truss construction, and internal chord 42 made with a pair of wires disposed generally parallel to each other, the composite of the wires of chord 42 being also parallel to flange 38.

FIG. 8 illustrates another suitable strengthening member which is a Bulb T, namely a single-piece extruded metal structural member.

The wall panels of this invention are fabricated as follows. The board 12 is cut to size in well known manner, to have flat major surface 14, and the desired length L1, width W1, and depth D1. Channels 20 are cut or otherwise formed between end surfaces 22, 24, with shape cooperatively configured to receive the Truss T's or other strengthening members to be used. Beds of adhesive 48, 50 are applied in the channels 20. Trusses 18 are preferably aligned parallel to and adjacent the respective channels, and are inserted into the channels by movement in directions generally transverse to the lengths of the aligned channels and trusses, such that the external flanges of the trusses are supported on the flange members of the channels, with bed of adhesive 50 therebetween as seen in FIG. 7, and with the internal chord 42 embedded in, and surrounded by, the bed of adhesive 48. The relative positions of the trusses and the board are then maintained while the adhesive cures, securing the trusses in place. When the adhesive has cured, the board can be further handled and manipulated as desired.

In preferred embodiments of the wall panels of this invention, an edge reinforcing element 70, such as a C-channel is emplaced about the perimeter of the major surface, namely along end surfaces 22, 24, and side surfaces 26, 28 to provide added strength and protection from abuse along the perimeter of the board. Such C channel is shown in cross-section on edge surface 26 and in fragmentary surface view on end surface 22, both in FIG. 5.

Channels 70 are emplaced by first providing appropriate slots 72, comprising recesses, in the board 12 around its end and side surfaces, to receive the lower flange 70L thereinto. Preferably the web 70W and upper flange 70U are disposed against the end and side surfaces, and against the major surface 14, respectively.

Adjacent end edges 22, 24, upper flange 70U is lapped over the end of flange 38 of the Truss T 18 (FIG. 5, edge 22), whereby the securement of lower flange 70L in slot 72 serves, through web 70W and upper flange 70U, to further secure the Truss T's against movement out of channels 20. Clips 56, as shown, can be installed at any time before C-channel 70 is installed.

The wall panels of this invention are installed on a building frame generally as follows. A wall panel is placed in cooperative attaching relationship with appropriate primary framing members of the building and held there by temporary supporting means such as a light-duty crane. The clips 56 are slid along the external flanges 38 such that the lips 64 engage the e.g. column 68 as shown in FIG. 8. Lips 64 are then fixedly secured to the columns, as by welds 65, whereupon the clips become structural, load bearing, extensions of the columns and the respective panel is held to the columns by clips 56 their sliding attachment over the external truss flanges 38, and the support of the crane can be released. This process is repeated as necessary to install the number of wall panels desired.

As stated, both the Truss T's and the channels 70 are metal, and so are good thermal conductors. As seen by the description of the construction of the wall panel, the description of its attachment to the buildings, and as illustrated by the drawings, the only thermal conductors in the wall panel are the Truss T's and the channels 79. Clips 56, of course do not extend measurably into the wall panel. As seen in the drawings, neither the Truss T's 18 nor the edge channels 70 extend all the way from major surface 14 to the major surface 16. Thus, that portion of the plastic foam board 12 which extends outwardly of the Truss T's and the channels 70, toward the outside surface of the wall panel provides a thermal break between the outside surface of the wall panel and the inner surface of the wall panel as defined by major surface 14 and external flange 38 of Truss T's 18.

A wall panel of this invention can span, and thus serve as a closure for, the entire free space between its ends, with all of the free space being permissively devoid of supporting building frame members. Accordingly, building secondary framing members such as studs or the like need not be specified for emplacement to support the wall panels between the panel ends. Attendant benefits of reduced costs and more efficient use of resources will be accordingly obtained.

EXAMPLE

A wall panel was made as follows. A polystyrene foam board was secured and prepared having length of 15 feet, width of 4 feet 10 inches, and overall thickness of 6 inches. Four channels as shown in FIG. 7 were cut along the length of the major surface to be mounted to the building frame, spaced 16 inches on center, with the outer channels spaced 5 inches from the side surfaces (26, 28). Beds of adhesive (48 and 50) were laid, using MOR-AD 434-A adhesive. Truss T's from Tech Truss Tees, Inc. were then laid in each channel along the full length thereof, less one inch at each end. The Truss T's were Style 5-6, 17-3.5, having overall depth of 3.5 inches, weight of 1.17 lb./ft., and resisting moment of 10,280 inch lbs. External flange (38) was specified as 17 gauge. After the adhesive had cured, 16 gauge C channels, with 3.5 inches between flanges were inserted around the perimeter as described above. Then a conventional acrylic skin composite material was applied, with fiberglass mesh, to complete fabrication of the wall panel.

A panel load test was set up to simulate a uniformly applied wind load imposed on the panel and its attachment to the building frame. The test bed consisted of rolled I-beams rigidly supported at each end on concrete blocks. The wall panel was secured to the underside of the I-beams using the clips 56 slideably installed on the panel and welded to the I-beams, as above described, whereby the major surface (14) of the panel was disposed upwardly. A containment was constructed around the panel perimeter, and free from the panel edges, to retain sand which was used for loading the panel.

Sand was applied to the panel and screeded level to distribute the load uniformly on the panel. The condition and deflection of the panel were observed as the loading progressed. The deflection is shown below for representative loadings. A ratio of L/180 is considered the maximum acceptable, where "L" is the span in inches.

| Loading, PSF | Deflection at Center of 15 Foot Span | Ratio |
|---|---|---|
| 20 | 0.48 inch | L/375 |
| 30 | 0.75 inch | L/240 |
| 40 | 1.0 inch | L/180 |

The condition of the wall panel remained good up to 50 PSF loading, where the test was terminated. The wall panel maintained the 50 PSF loading for 38 hours with no significant change in condition.

The above test results suggest that the 15 foot long panel so tested can be mounted to a building having primary framing members spaced 15 feet on center, and safely withstand a wind loading of 40 PSF, which is twice the normal wind load design criteria. Similar wall panels can now be designed for a variety of frame spacings, using the same general design criteria.

While use of C-channels 70 as edge reinforcement is preferred, acceptable strength to accept 20 PSF live load can usually be obtained without use of any edge reinforcement, and so wall panels without such reinforcement are included in the definition of this invention.

Figure 1:
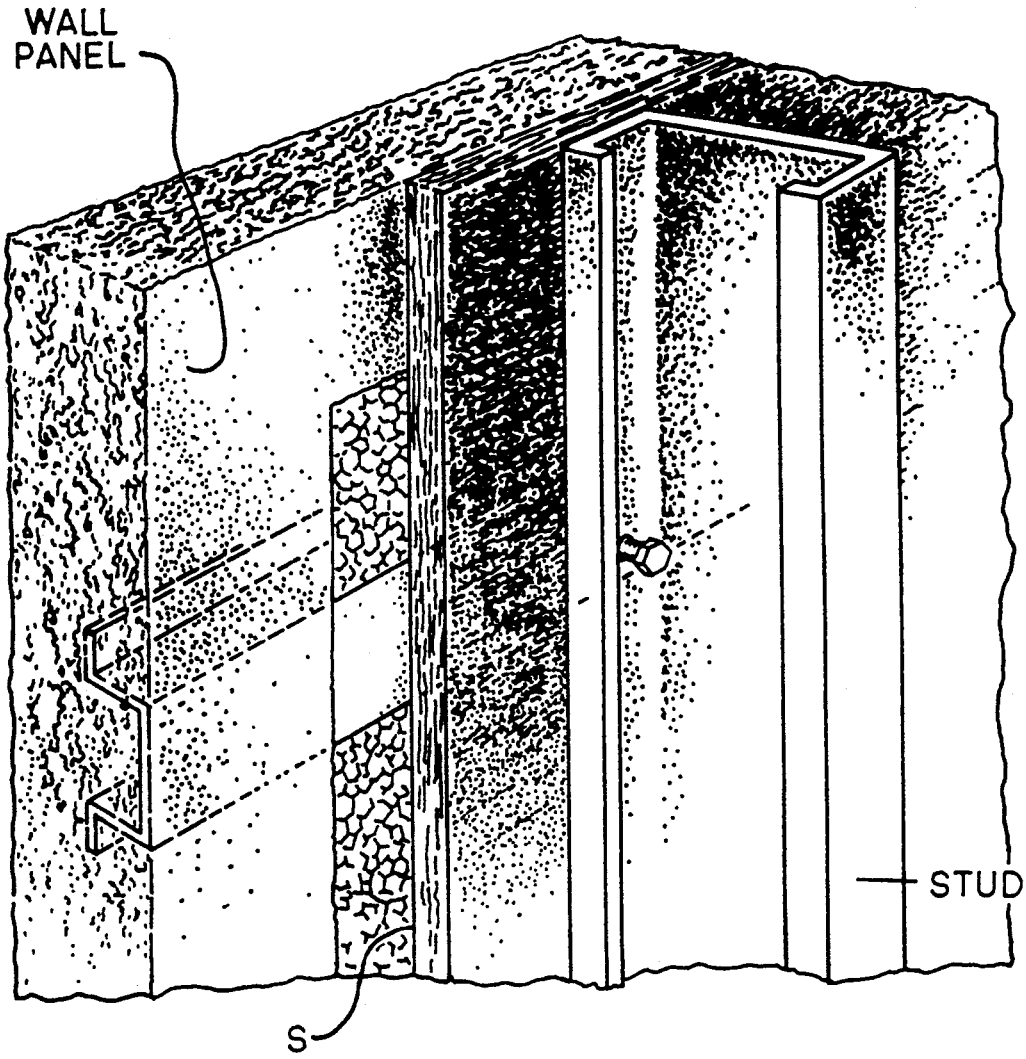
FIG. 1 PRIOR ART
FIGS. 1-2 are fragmentary pictorial views of wall structures using wall panels of the prior art.
Figure 2:
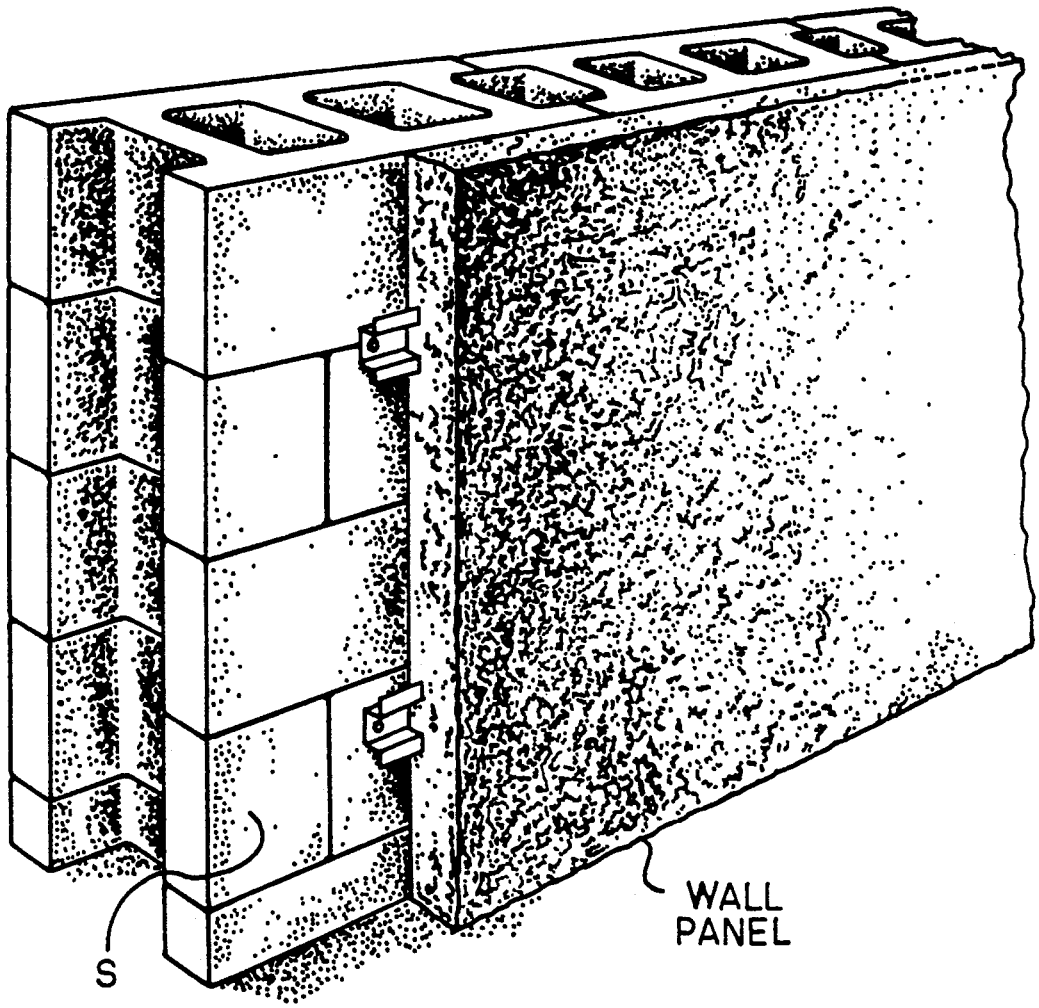
FIG. 2 PRIOR ART
Figure 4:
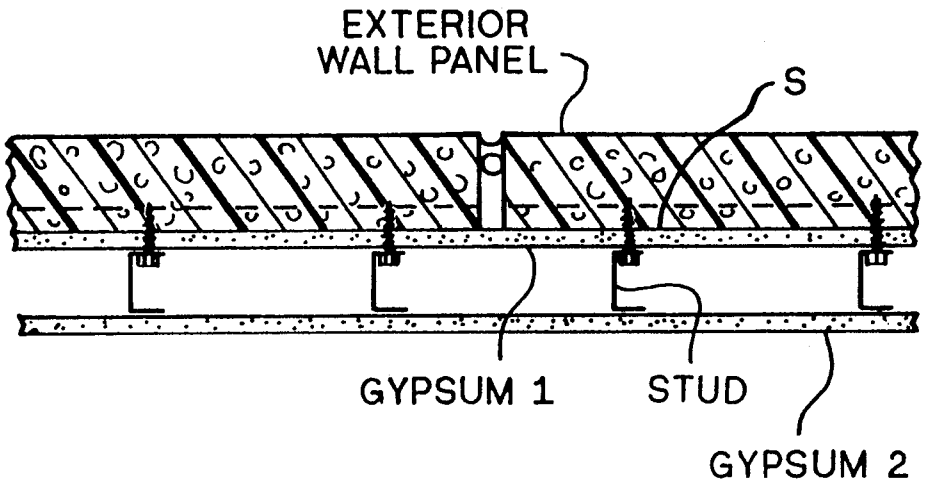
FIG. 4 PRIOR ART
FIG. 4 is a top cross-section view of the prior art wall of FIG. 3.

Referring, now, to the building wall cross sections seen in FIG. 9 and in Prior Art FIG. 4, it is seen that in the wall structure of Prior Art FIG. 4, the "Gypsum 1" layer is required on the outside of the stud wall (exterior of the building) as a sheathing support for the non-structural exterior wall panel of the prior art. The "Gypsum 2" layer forms the interior wall of the building, to be finished as desired. So two gypsum layers are required in the prior art, with studs typically spaced 16 inches or 24 inches on center to adequately support the gypsum layers. The "Gypsum 1" layer serves as the required fire barrier.

As seen in FIG. 9, the wall systems made using structural wall panels of this invention do not require a supporting exterior substrate (e.g. Gypsum 1, FIG. 4) to support them. Rather, the structural wall panel 10 is secured directly to the primary framing members 68 using clips 56. The interior gypsum layer 74 serves both as the fire barrier and as the interior wall of the building, to be finished as desired.

Wall panels of this invention can be made in a variety of sizes and thicknesses. Each new panel size can be readily engineered for its specific application using conventionally known design techniques to select compatible combinations of parameters including e.g. the truss specifications, the truss spacing in the board, and the distance between primary framing members in the building.

The invention also provides structural wall panels which make up a generally light weight wall structure.

The invention provides wall structures which are lighter in weight, are less costly to fabricate, and can be erected more quickly, and with lighter equipment and less on-site labor, than conventional wall structures.

Moreover, the invention provides a structural wall panel incorporating structural members in a plastic foam board substrate, such that the sheathing support layer (Gypsum 1, FIG. 4) required for use with "cladding" type wall panels of the prior art is not needed or used.

By "structural wall panel" I mean an exterior wall panel which can span between primary structural framing members of the building without surface supporting assistance of any intervening structural element, or supporting substrate such as gypsum board in combination with supporting studs. I specifically exclude conventional (secondary framing) studs at 16 inches or 24 inches on center from defining the maximum span.

Accordingly, the length of the building wall panel, as it spans between e.g. vertical wide flange columns 68. illustrated in FIG. 9, is necessarily greater than 24 inches.

While the EXAMPLE illustrated a wall panel length of 15 feet, any length up to 15 feet can clearly be designed and built. Lengths longer than 15 feet are contemplated, and can now be designed using ordinary engineering procedures.

Preferred board is polystyrene foam having density of about 1 to about 1.5 pounds per cubic foot; this recitation being illustrative only, and not limiting. Other plastic foam materials are acceptable to the extent they provide the necessary thermal insulation and can be adequately secured to the reinforcing structural members to make effectively unitary wall panels.

Structural wall panels of this invention can be applied at any angle from vertical up to and including horizontal. The term "wall panels" as used herein includes panels which are used as roof panels.

Those skilled in the art will now see that certain modifications can be made to the building wall panels and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A preformed structural exterior building wall panel, for placement on a building, said building wall panel comprising:

(a) a board comprising an effectively unitary slab of plastic foam material having a first major surface for disposition toward the interior of a building, and a second major surface, opposing said first major surface, for disposition toward the exterior of a building, said first major surface having a spaced apart channel extending thereacross, to receive a structural member thereinto, said channel having a depth;

(b) an elongate structural member secured in said channel and extending substantially across the entire respective dimension of said major surface of said board, said structural member, as secured in said channel, comprising (i) an external flange disposed adjacent said major surface of said board, said external flange extending in a direction transverse to the depth of said channel and supporting said major surface of said board, (ii) a web extending from said external flange into the interior of said board and terminating on the interior of said board, between said first and second major surfaces, and (iii) an internal flange extending transversely from said web on the interior of said board, the dimensions of said internal flange transverse to said web, and said width of said channel, being cooperatively sized and configured such that said internal flange is received within said channel along the extent of the respective said depth as taken progressively from said first major surface, and (c) a bed of adhesive in said channel and surrounding said internal flange, whereby a portion of said bed of adhesive is disposed between said internal flange and said first major surface of said board.

2. A structural exterior building wall panel as in claim 1, said wall panel having a length and a width defining an area thereof, said wall panel having an inner surface, said inner surface being comprised of said first major surface of said board and said external flange of said reinforcing structural member, said wall panel further having an outer surface disposed generally outwardly of said second major surface of said board, an exterior portion of said plastic foam board extending outwardly of said internal flange and toward said outer surface of said wall panel, said exterior portion of said plastic foam board comprising a thermal break between said inner and outer surfaces of said wall panel about the entire said area of said wall panel.

3. A structural exterior building wall panel as in claim 1, said wall panel further having an outer surface disposed generally outwardly of said second major surface of said board, said plastic foam material of said board having a heat insulation value of at least R4 per inch thickness between said internal flange and said outer surface of said wall panel.

4. A structural exterior building wall panel as in claim 1 whereby, when said building wall panel is attached to a building, said structural member receives the primary wind loading on said exterior building wall panel from said plastic foam board and passes the wind loading directly to primary framing members.

5. A structural exterior building wall panel as in claim 1, said board having a plurality of edge surfaces about the perimeter of said first major surface, said structural members having ends of said external flanges disposed adjacent opposing said edge surface, said board having, on said edge surface, elongate slots parallel to said first major surface and recessed into said edge surfaces between said first and second major surfaces, said slots being adapted to receive reinforcing members therein along the lengths of the respective said edge surfaces, and elongate reinforcing elements having a C-channel shaped cross-section, including a web joining a pair of oppositely disposed, generally parallel flanges, one said flange being secured in the respective said slot between said first and second major surfaces, the other said flange being disposed proximate the respective said edge surface on, and extending over, a respective edge portion of said major surface, and over end portions of said respective external flanges.

6. A structural exterior building wall panel as in claim 1, said bed of adhesive comprising a first bed of adhesive, and a second bed of adhesive between said external flange of said structural member and an underlying portion of said board.

7. A structural exterior building wall panel as in claim 1, each said channel in said plastic foam board comprising a pair of channel members, each said structural member comprising an external flange extending along the length thereof, a pair of webs opposing sides of said external flange along the length of said external flange, extending from said first major surface into said board toward said second major surface, and internal flange members on each said web, said internal flange members on each said web extending transversely from the respective said web, the dimensions of said internal flange members transverse to said web and the width of the respective said channel members being cooperatively sized and configured such that the respective said internal flange members can be received within the respective said channel members, along the extent of said depths as taken progressively from said first major surface.

8. A structural exterior building wall panel as in claim 1 and including clips secured onto said external flanges, said clips having limited moveability along the lengths of the respective said elongate structural members, said clips being configured to be fixedly joined to primary framing members of the building, and to thereby become structural extensions of the primary framing members of the building, whereby the moveable securement of said clips to said external flanges accommodates minor shifting of the building elements.

9. A building comprising a structural exterior building wall panel of claim 1.

10. A preformed structural exterior building wall panel as in claim 1, said wall panel having a length, said structural member having a length disposed along the length of said wall panel, and wherein when said length of said wall panel spans between upstanding primary framing members of the building, said reinforcing structural member is disposed in a generally horizontal direction.

11. A structural exterior building wall panel as in claim 6, and including a space in said channel between said first and second beds of adhesive, said space being substantially free from functionally effective amounts of adhesive.

* * * * *